US008081151B2

(12) United States Patent
Kishimoto et al.

(10) Patent No.: US 8,081,151 B2
(45) Date of Patent: Dec. 20, 2011

(54) DRIVER CONTROLLER FOR CONTROLLING A PLURALITY OF DATA DRIVER MODULES INCLUDED IN A DISPLAY PANEL

(75) Inventors: Yoshihiro Kishimoto, Osaka (JP); Takeru Yamashita, Osaka (JP); Hiroyuki Kakinuma, Osaka (JP); Masayuki Tagami, Osaka (JP); Teruaki Takeuchi, Osaka (JP)

(73) Assignee: Panasonic Corporation, Osaka (JP)

( * ) Notice: Subject to any disclaimer, the term of this patent is extended or adjusted under 35 U.S.C. 154(b) by 961 days.

(21) Appl. No.: 11/643,699

(22) Filed: Dec. 22, 2006

(65) Prior Publication Data

US 2007/0273632 A1 Nov. 29, 2007

(30) Foreign Application Priority Data

May 25, 2006 (JP) ..... 2006-145748

(51) Int. Cl.
*G09G 3/36* (2006.01)

(52) U.S. Cl. ..... 345/99; 345/100

(58) Field of Classification Search ..... 345/87, 345/99

See application file for complete search history.

(56) References Cited

U.S. PATENT DOCUMENTS

| | | | | |
|---|---|---|---|---|
| 5,379,408 | A * | 1/1995 | Izzi et al. | 713/501 |
| 5,706,484 | A * | 1/1998 | Mozdzen et al. | 713/400 |
| 6,229,513 | B1 * | 5/2001 | Nakano et al. | 345/99 |
| 6,522,359 | B1 * | 2/2003 | Yamashita | 348/312 |
| 6,867,759 | B1 * | 3/2005 | Baek et al. | 345/99 |
| 6,980,192 | B1 * | 12/2005 | Matsumura et al. | 345/99 |
| 2003/0214495 | A1 * | 11/2003 | Koyama | 345/204 |
| 2004/0202263 | A1 * | 10/2004 | Choi | 375/354 |
| 2005/0030275 | A1 * | 2/2005 | Kwon | 345/100 |
| 2005/0286667 | A1 * | 12/2005 | Joo et al. | 375/354 |
| 2006/0256063 | A1 * | 11/2006 | An | 345/98 |

FOREIGN PATENT DOCUMENTS

JP 2003-8424 1/2003

* cited by examiner

*Primary Examiner* — Chanh Nguyen
*Assistant Examiner* — Kwang-Su Yang
(74) *Attorney, Agent, or Firm* — McDermott Will & Emery LLP

(57) ABSTRACT

Data driver modules are connected to a driver controller. In driver-data output clock selection sections and driver data control sections, each equal in number to the data driver modules that are connected to the driver controller, the phase of driver data is adjusted for each data driver module, while the phase of each driver clock is adjusted in driver-clock output clock selection sections and driver clock control sections.

20 Claims, 13 Drawing Sheets

DRIVER CONTROLLER FOR CONTROLLING A PLURALITY OF DATA DRIVER MODULES INCLUDED IN A DISPLAY PANEL

BACKGROUND OF THE INVENTION

The present invention relates to a driver controller for controlling multiple data drivers in a display panel, such as a PDP (plasma display panel) or an LCD (liquid crystal display).

In recent years, as the use of display panels, such as PDPs and LCDs, has become widespread, the screen size and the definition thereof have been increasing at a rapid pace. These display panels have hundreds to thousands of signal lines in the horizontal and vertical directions and realize panel display by driving these signal lines by associated multiple data drivers and a scanning driver.

Typically, a plurality of data drivers are cascade-connected to form data driver modules and the driving thereof is controlled by a corresponding driver controller. The cascade connection reduces the number of signals driven in parallel, but in a high-definition display panel, the driver controller needs to drive signals which range from several dozens to more than one hundred. In addition, as the display panel screen size has been increased, the load capacitances between the driver controller and the data driver modules have been increased, which requires the driver controller to have high output drive capability.

However, at the time when the driver controller drives more than one hundred signals by using its high output drive capability, if these signal lines change concurrently in the same direction depending upon display data, large amounts of transient current flow in output buffers in the driver controller. This causes power supply voltage and ground voltage supplied to the driver controller to vary greatly, which results in noise adversely affecting the driver controller itself and the peripheral devices thereof.

Therefore, according to a conventional technique, a delay circuit is inserted for each output bit so as to delay the points in time when respective output data change, so that the transient currents instantaneously passing through the output buffers reach their peaks at different points in time. This reduces noise occurring due to variation in power supply voltage and ground voltage in the driver controller (see Japanese Laid-Open Publication No. 2003-8424).

With the increase in the display panel screen size, signal line skews, resulting from the increased load capacitances between the driver controller and the data driver modules, have been increasing, while the operating frequency has been raised as performance has been enhanced. It has thus become difficult to satisfy AC timing of the data driver modules.

However, for the above-described conventional technique, which uses the delay circuits to delay the points in time when the respective data change, it is difficult to achieve highly-precise phase control, because of ambient temperature, voltage variation, and other conditions. In addition, the conventional technique has the drawback of lacking a mechanism for adjusting AC timing.

SUMMARY OF THE INVENTION

The present invention has been made to overcome the above problems, and it is therefore an object of the present invention to provide a driver controller, in which noise caused by variation in power supply voltage resulting from output concurrent change is reduced, and optimization of AC timing is achieved even when propagation skew among data driver modules is increased with increase in display panel size.

In order to achieve the object, according to the present invention, in driver-data output clock selection sections and driver data control sections, each equal in number to data driver modules that are connected to the driver controller, the phase of driver data is adjusted for each data driver module, while the phase of each driver clock is adjusted in driver-clock output clock selection sections and driver clock control sections. This allows outputs to the corresponding data driver modules to change at different points in time. Also, driver data output clocks are selected with propagation skew among the data driver modules being a phase difference for each driver data control section, whereby AC timing in all data driver modules is optimized.

According to the present invention, individual phase-adjustment is performed for the timing of the output of the respective driver data and respective driver clocks to the data driver modules. This permits the respective driver data to change at different points in time, whereby the occurrence of noise is reduced, and even if there is propagation skew, optimization of AC timing is achievable.

DETAILED DESCRIPTION OF THE INVENTION

Figure 1:
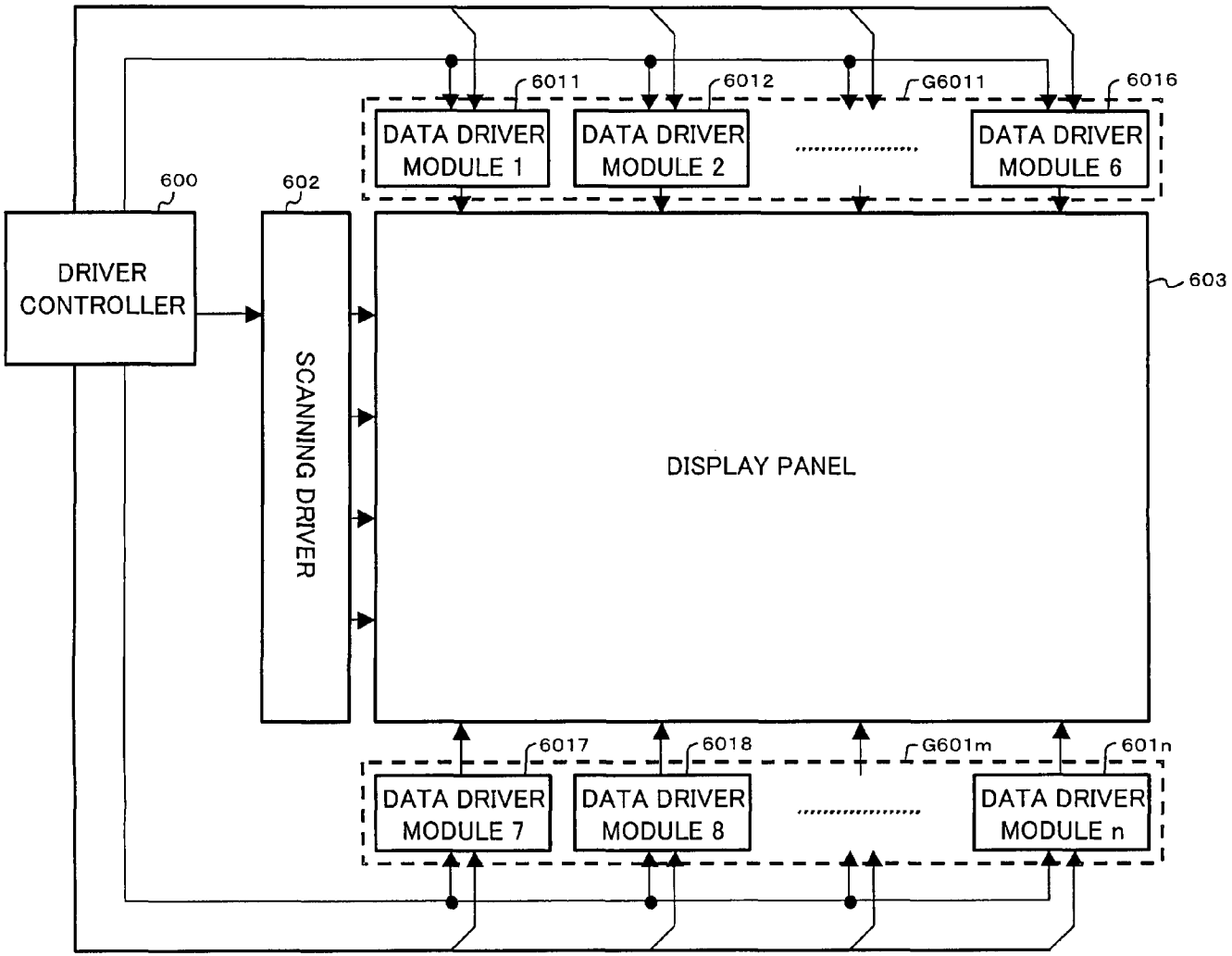
FIG. 1 is a block diagram illustrating a structure of a display system including a driver controller according to the present invention.

FIG. 1 illustrates an example of a display system including a driver controller according to the present invention. The display system shown in FIG. 1 includes a plurality of data driver modules 6011 to 601*n* (where n is an integer equal to or greater than 2) and a scanning driver 602. The driver controller 600 outputs driver data, driver clocks, and other control signals to the data driver modules 6011 to 601*n* to drive a display panel 603. Also, the data driver modules 6011 to 601*n* form m group or groups (where m is any integer equal to or greater than 1) as shown by G6011 to G601*m*, and the data driver modules in the same group are driven by the same driver clock.

Figure 3:
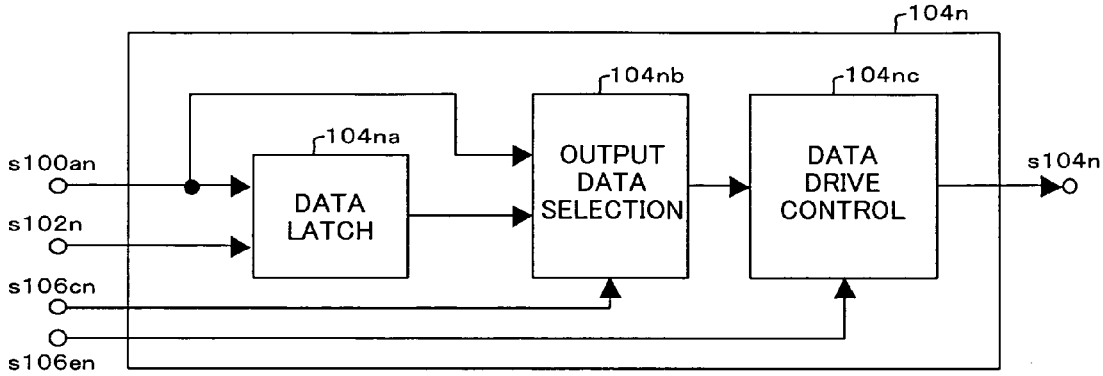
FIG. 3 is a block diagram illustrating the structure of a driver data control section in the driver controller according to the embodiment of the present invention.
Figure 4:
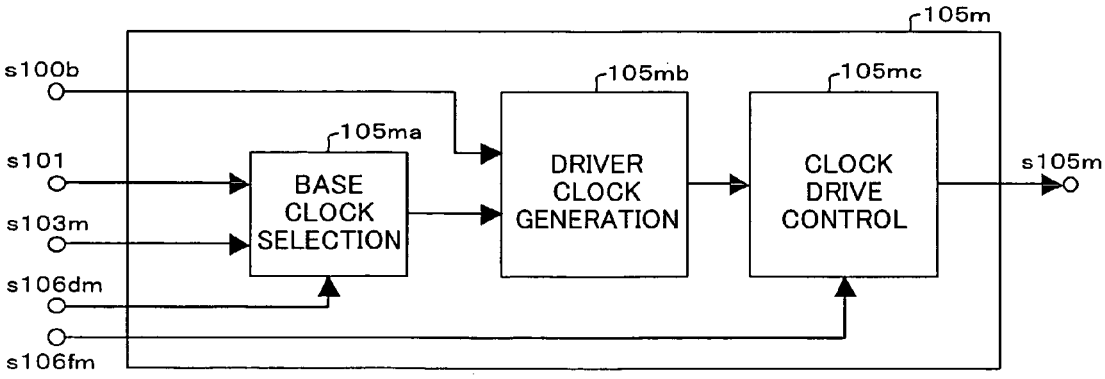
FIG. 4 is a block diagram illustrating the structure of a driver clock control section in the driver controller according to the embodiment of the present invention.

Hereinafter, the driver controller 600 according to an embodiment of the present invention will be described in detail with reference to FIGS. 2 to 4.

Figure 2:
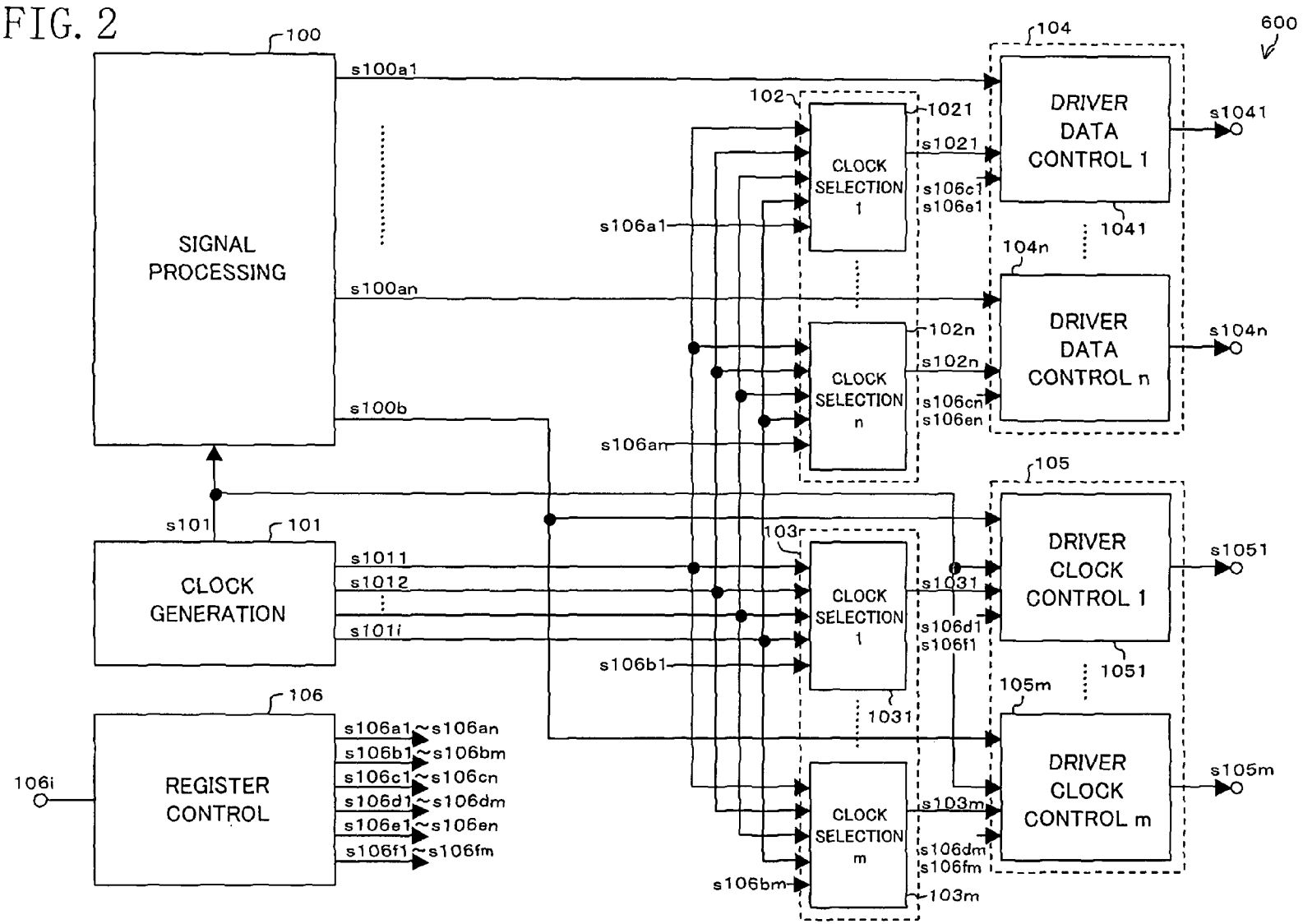
FIG. 2 is a block diagram illustrating the structure of the driver controller according to an embodiment of the present invention.

FIG. 2 illustrates the driver controller 600 according to the embodiment of the present invention. In FIG. 2, the reference numeral 100 denotes a signal processing section, which processes and converts an input video signal into k-bit data signals s100*a*1 to s100*an* (where k is an integer equal to or greater than 2) for driving the n data driver modules 6011 to 601*n*, while outputting an output enable signal s100*b* indicating a validity period of driver data.

The reference numeral 101 indicates a clock generation section, which generates a system clock s101 for the driver controller 600, while generating a plurality of clocks s1011 to s101*i* having different phases (where i is an integer equal to or greater than 2) with the system clock s101 used as a reference phase. These clocks having different phases may be generated by a PLL or a DLL, for example.

The reference numeral 102 indicates driver-data output clock selection sections. The number of driver-data output clock selection sections provided is n so as to correspond to the n data driver modules 6011 to 601*n*. The driver-data output clock selection sections 1021 to 102*n* each select one of the clocks s1011 to s101*i* with different phases generated by the clock generation section 101, in accordance with an associated selection signal s106*a*1, . . . or s106*an* from a register control section 106 (which will be described later) and output a driver data output clock s1021, . . . or s102*n*.

The reference numeral 103 indicates driver-clock output clock selection sections. The number of driver-clock output clock selection sections provided is m so as to correspond to the m groups of the n data driver modules 6011 to 601*n*, that is, G6011 to G601*m*. The driver-clock output clock selection sections 1031 to 103*m* each select one of the clocks s1011 to s101*i* with different phases generated by the clock generation section 101, in accordance with an associated selection signal s106*b*1, . . . or s106*bm* from the register control section 106 and output a driver clock output clock s1031 to s103*m*.

The reference numeral 104 indicates driver data control sections. The number of driver data control sections provided is n so as to correspond to the n data driver modules 6011 to 601*n*. The driver data control sections 1041 to 104*n* latch the respective data signals s100*a*1 to s100*an* from the signal processing section 100 by the respective driver data output clocks s1021 to s102*n* from the driver-data output clock selection sections 1021 to 102*n* and each select either one of the latch signal and the associated data signal s100*a*1, . . . or s100*an* in accordance with an associated selection signal s106*c*1, . . . or s106*cn* from the register control section 106. Thereafter, the driver data control sections 1041 to 104*n* determine the drive capability of the respective selected signals in accordance with selection signals s106*e*1 to s106*en* from the register control section 106 and output, as driver data s1041 to s104*n*, the respective selected signals from their output ports to the corresponding data driver modules 6011 to 601*n*.

The reference numeral 105 denotes driver clock control sections. The number of driver clock control sections provided is m so as to correspond to the m groups of the n data driver modules 6011 to 601*n*, that is, G6011 to G601*m*. During a time period in which the output enable signal s100*b* from the signal processing section 100 indicates the active state, the driver clock control sections 1051 to 105*m* determine the drive capability of respective driver clocks s1051 to s105*m* in accordance with selection signals s106*f*1 to s106*fm* from the register control section 106 and thereafter output the driver clocks s105 to s105*m* from their respective output ports to the corresponding data driver module groups G6011 to G601*m*. Each of the driver clocks s105 to s105*m* is synchronized with either one of the system clock s101 and the associated driver clock output clock s1031, . . . or s103*m* according to an associated selection signal s106*d*1, . . . or s106*dm* from the register control section 106.

The reference numeral 106 denotes the register control section for outputting the above-mentioned various selection signals s106*a*1 to s106*an*, s106*b*1 to s106*bm*, s106*c*1 to s106*cn*, s106*d*1 to s106*dm*, s106*e*1 to s106*en*, and s106*f*1 to s106*fm* in response to inputs (e.g., $I^2C$ compatible serial inputs) from an external port 106*i*.

Now, the driver data control section 104*n* will be described in detail with reference to FIG. 3. The reference numeral 104*na* denotes a data latch section for latching the data signal s100*an* by the driver data output clock s102*n* and outputting the latch data.

The reference numeral 104*nb* indicates an output data selection section for selecting either the data signal s100*an* or the latch data in accordance with the selection signal s106*cn* and outputting the selected data.

The reference numeral 104*nc* denotes a driver data drive control section, which determines the drive capability of the selected data in accordance with the selection signal s106*en* and outputs, as the driver data s104*n*, the selected signal from the output port thereof to the corresponding data driver module 601*n*.

Now, the driver clock control section 105*m* will be described in detail with reference to FIG. 4. The reference numeral 105*ma* denotes a base clock selection section, which selects either the system clock s101 or the driver clock output clock s103*m* in accordance with the selection signal s106*dm* and outputs a base clock.

The reference numeral 105*mb* indicates a driver clock generation section, which outputs a pre-driver clock in synchronization with either the positive or negative edge of the base clock during a time period (e.g., a period H) in which the output enable signal s100*b* indicates the active state. The determination as to whether the pre-driver clock is synchronized with the positive or negative edge may be made in advance or may be made by the register control section 106.

The reference numeral 105*mc* denotes a driver clock drive control section, which determines the drive capability of the pre-driver clock in accordance with the selection signal s106*fm* and outputs, as the driver clock s105*m*, the pre-driver clock from the output port thereof to the corresponding data driver module group G601*m*.

Next, the operation of the driver controller 600 will be described in detail with reference to FIGS. 5 to 7.

Figure 5:
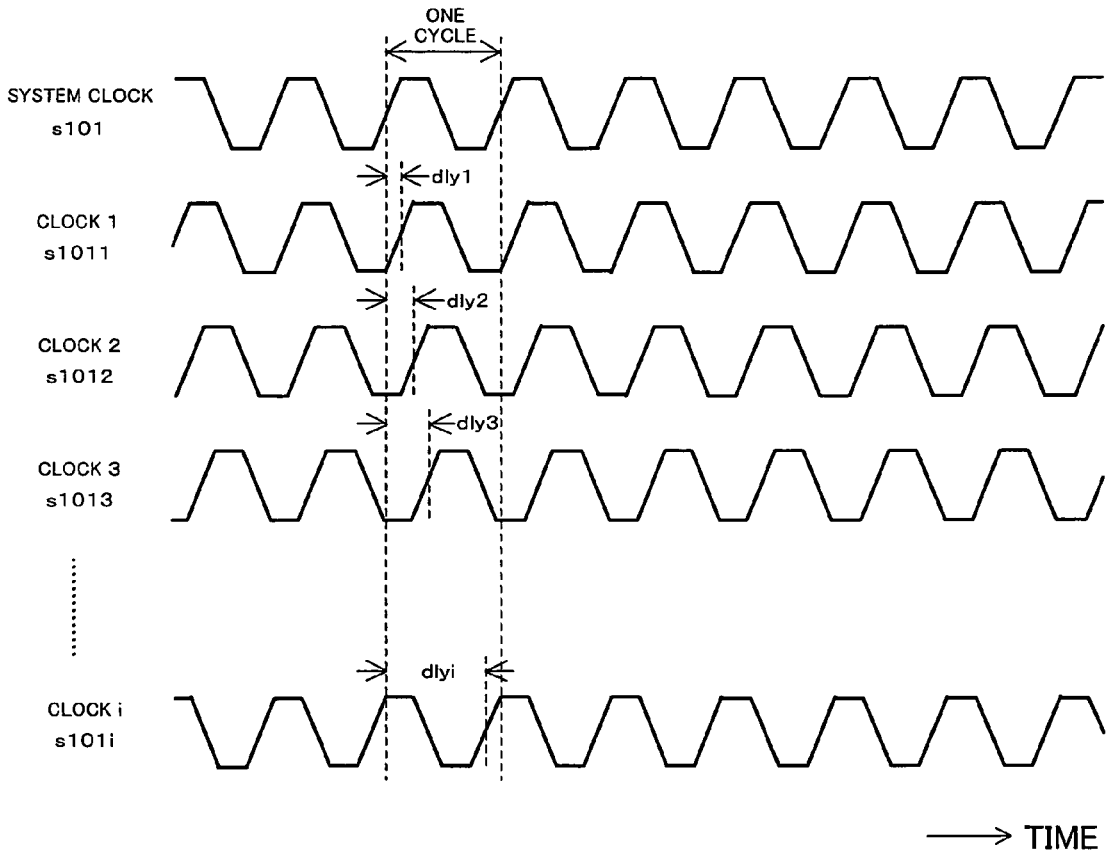
FIG. 5 is a timing chart for a clock generation section in the driver controller according to the embodiment of the present invention.

FIG. 5 is a timing chart for the clock generation section 101. The system clock s101 is generated by using a PLL, for example, while, at the same time, by using a phase delay in each stage of a phase-controlled multi-stage delay line in the PLL, it is possible to obtain the multiple clocks s1011 to s101*i* with different phases that correspond to the number of stages of the delay line. Alternatively, a DLL can likewise generate a plurality of clocks having different phases corresponding to the number of stages of the delay line therein. At this time, with the phase of the system clock s101 being zero degree, a minimum phase difference dly1 between the clock s1011 and the system clock s101 is equal to or greater than a phase in which at least data transmission from the system clock s101 to the clock s1011 is possible, while a maximum phase difference dlyi is smaller than 360°, i.e., shorter than one cycle of the system clock s101. Moreover, by generating clocks that are j times as many as the system clock s101 (where j is an even number equal to or greater than 2) by the PLL, it is also possible to obtain 2j clocks having different phases. In this manner, the use of phase-controlled clocks enables realization of highly precise phase difference that is not affected by ambient temperature, voltage variation, and other conditions.

Figure 6:
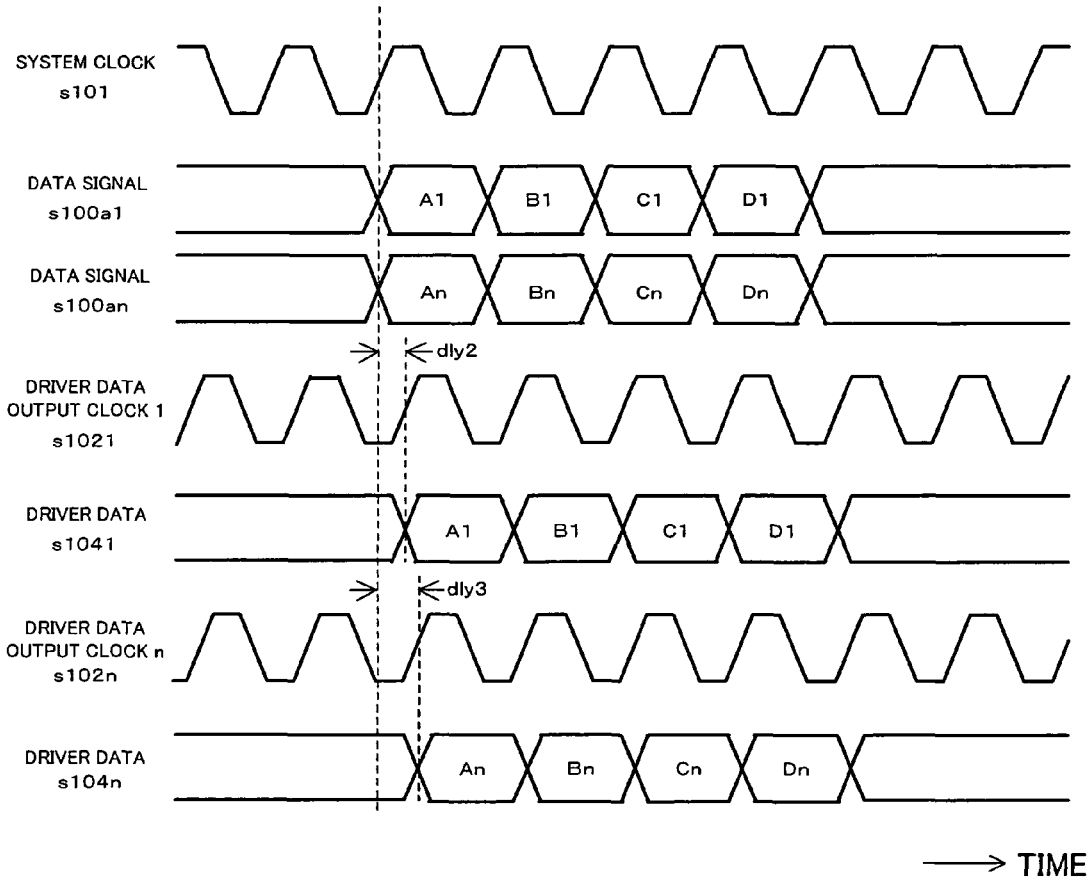
FIG. 6 is a timing chart for driver data control sections in the driver controller according to the embodiment of the present invention.

FIG. 6 is a timing chart for the driver data control sections 104. The data signals s100*a*1 to s100*an* synchronized with the system clock s101 are latched by the driver data output clocks s1021 to s102*n*, respectively. For example, FIG. 6 indicates a case in which for the clock s1021, a clock having a phase difference dly2 with respect to the system clock s101 is selected from the above-described clocks with different phases from the clock generation section 101, while for the clock s102*n*, a clock having a phase difference dly3 with respect to the system clock s101 is selected from those clocks having different phases.

The driver data control section 1041 drives the data latched by the driver data output clock s1021 and outputs the driver data s1041, while the driver data control section 104*n* drives the data latched by the driver data output clock s102*n* and outputs the driver data s104*n*. The driver data having the phase differences are thus output to the data driver modules to thereby allow the respective driver data to change at different points in time, whereby noise in power supply voltage or ground caused by transient current can be reduced. Also, by making it possible to set the drive capability of the respective driver data to any values, the drive capability can be optimized according to the load capacitances of the respective driver data output ports, thereby enabling the signal quality to be improved and unnecessary current consumption to be reduced.

In the driver data control sections 1041 to 104*n*, the data signals s100*a*1 to s100*an* synchronized with the system clock s101 may be selected instead of the latch data.

Figure 7:
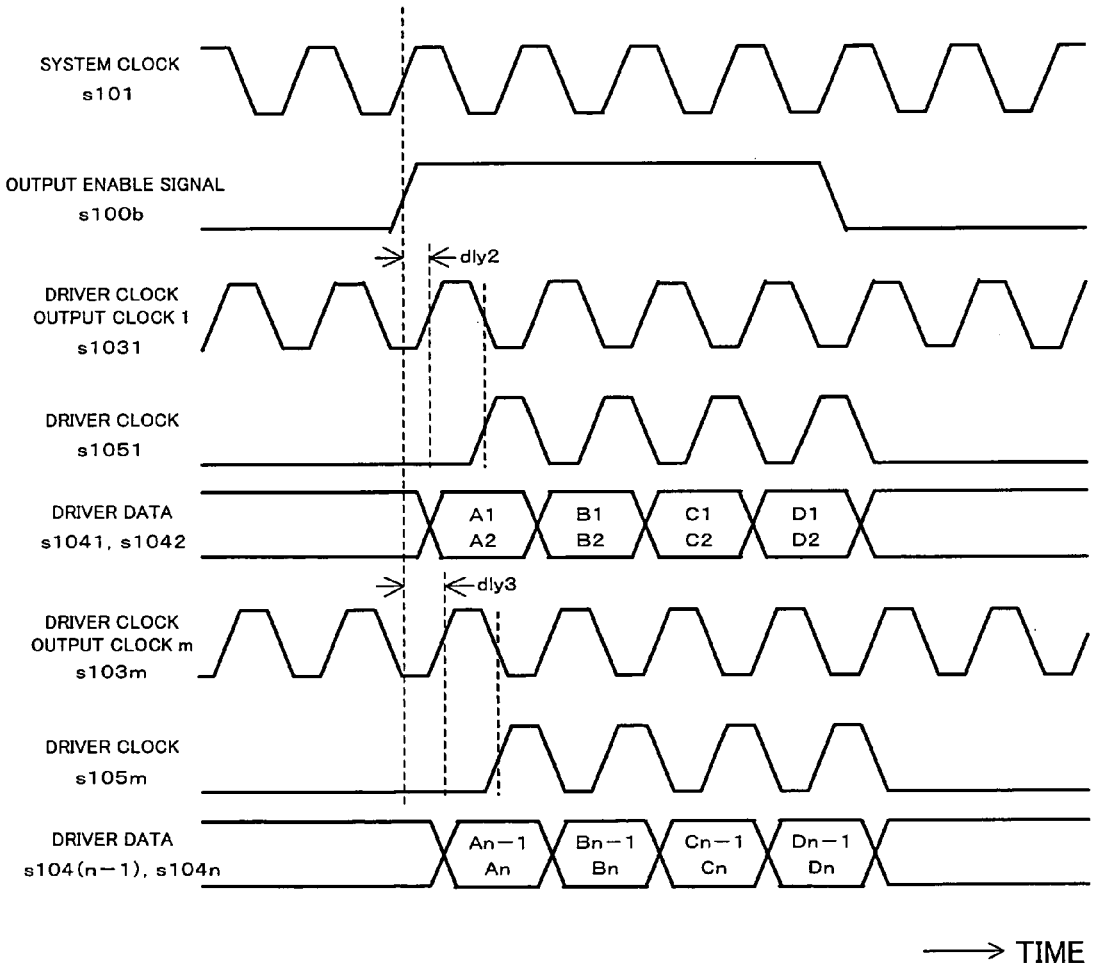
FIG. 7 is a timing chart for driver clock control sections in the driver controller according to the embodiment of the present invention.

FIG. 7 is a timing chart for the driver clock control sections 105. The driver clocks s105 to s105*m* synchronized with the negative edges of the driver clock output clocks s1031 to s103*m* are output during a time period (a period H in this embodiment) in which the output enable signal s100*b* indicates the active state. For example, FIG. 7 indicates a case in which for the driver clock output clock s1031, a clock having a phase difference dly2 with respect to the system clock s101 is selected from the above-described clocks having different phases from the clock generation section 101, while for the driver clock output clock s103*m*, a clock having a phase difference dly3 with respect to the system clock s101 is selected from those clocks having different phases.

The driver clock control section 1051 outputs the driver clock s105 that is synchronized with the negative edge of the driver clock output clock s1031, while the driver clock control section 105*m* outputs the driver clock s105*m* that is synchronized with the negative edge of the driver clock output clock s103*m*. At this time, the driver clock s105 corresponds to the driver data s1041 and s1042, while the driver clock s105*m* corresponds to the driver data s104(*n*−1) and s104*n*. In this way, since the driver clocks can correspond to any multiple number of driver data, the number of driver clocks for driving the data driver modules 6011 to 601*n* can be smaller than the number of data driver modules 6011 to 601*n*. Also, in a case where propagation skew among the data driver modules is large, data driver modules whose skews are close to each other are grouped together and the driver clocks having phase differences are output to the data driver module groups G6011 to G601*m*, whereby noise reduction and optimization of AC timing are both achievable. In addition, by making it possible to set the output drive capability of the driver clocks to any values, the drive capability can be optimized according to the load capacitances of the driver clock output ports, whereby the signal quality can be improved, and even when many data driver modules are driven, the driving can be realized with a small number of components without adding an external drive buffer and the like.

It will easily be appreciated that the driver clock control sections 1051 to 105*m* may output the driver clocks synchronized with the positive edges of the respective driver clock output clocks s1031 to s103*m*.

As stated above, in the driver controller 600 according to the embodiment of the present invention, highly-precise individual phase-adjustment can be made for the timing of the output of the respective driver data and respective driver clocks to the data driver modules 6011 to 601*n*. As a result, the respective driver data change at different points in time, whereby the occurrence of noise is reduced, and even in the case of large propagation skew, optimization of AC timing is achieved by appropriately combining the driver data and the driver clocks.

FIRST MODIFIED EXAMPLE

Next, a first modified example of the above-described embodiment will be described with reference to FIGS. 8 and 9. In this modified example, driver clock control sections 205 generate differential driver clocks.

Figure 8:
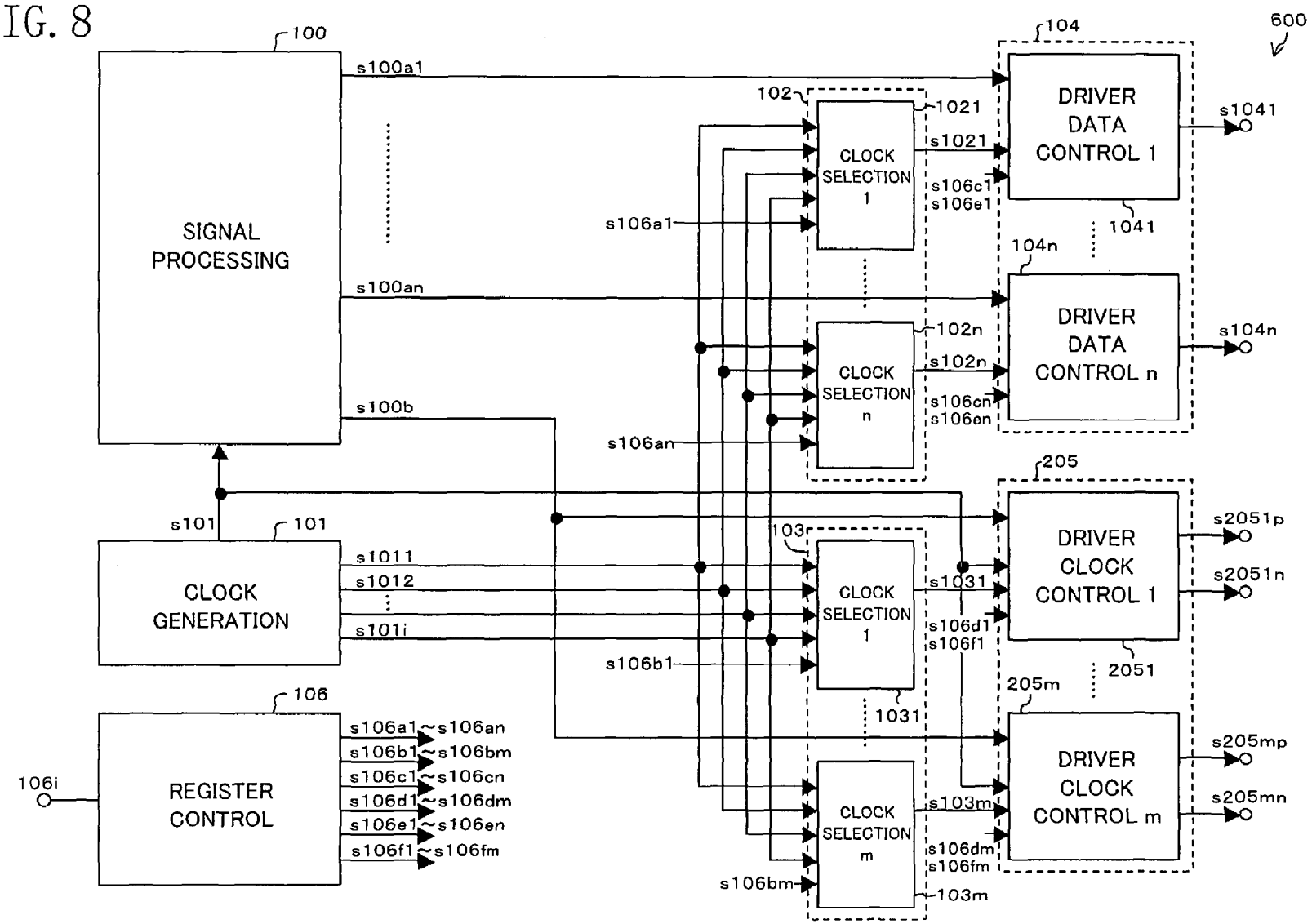
FIG. 8 is a block diagram illustrating the structure of a driver controller according to a first modified example of the embodiment of the present invention.
Figure 9:
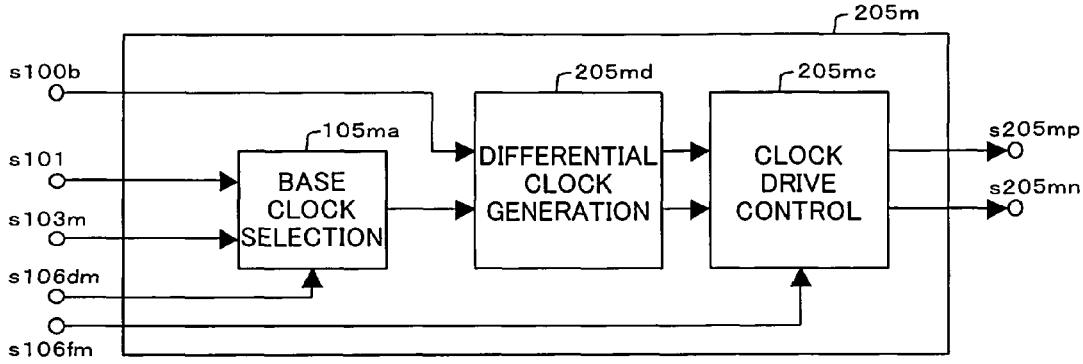
FIG. 9 is a block diagram illustrating the structure of a driver clock control section in the driver controller according to the first modified example of the embodiment of the present invention.

Specifically, in FIG. 8, the reference numeral 205 indicates the driver clock control sections. The number of driver clock control sections provided is m so as to correspond to the m groups of the n data driver modules 6011 to 601*n*, that is, G6011 to G601*m*. During a time period in which the output enable signal s100*b* from the signal processing section 100 indicates the active state, driver clock control sections 2051 to 205*m* determine the drive capability of respective differential driver clocks s2051*p* to s205*mp* and s2051*n* to s205*nm*, the frequency of each of which is one-half of that of the system clock s101, according to the respective selection signals s106*f*1 to s106*fm* from the register control section 106 and thereafter each output the associated differential driver clocks s2051*p*, . . . or s205*mp* and s2051*n*, . . . or s205*nm* from the output ports thereof to the corresponding data driver module group G6011, . . . or G601*m* in synchronization with either one of the system clock s101 and the associated driver clock output clock s1031, . . . or s103*m* in accordance with the associated selection signal s106*d*1, . . . or s106*dm* from the register control section 106.

Now, the driver clock control section 205*m* will be described with reference to FIG. 9. The reference numeral 205*md* denotes a differential clock generation section, which outputs differential pre-driver clocks in synchronization with either the positive or negative edge of the base clock during a time period (e.g., a period H) in which the output enable signal s100*b* indicates the active state. The determination as to whether the differential pre-driver clocks are synchronized with the positive or negative edge may be made in advance or may be made by the register control section 106.

The reference numeral 205*mc* denotes a driver clock drive control section, which determines the drive capability of the differential pre-driver clocks in accordance with the selection signal s106*fm* and outputs, as the differential driver clocks s205*mp* and s205*nm*, the pre-driver clocks from the output ports thereof to the corresponding data driver module group G601*m*.

Figure 10:
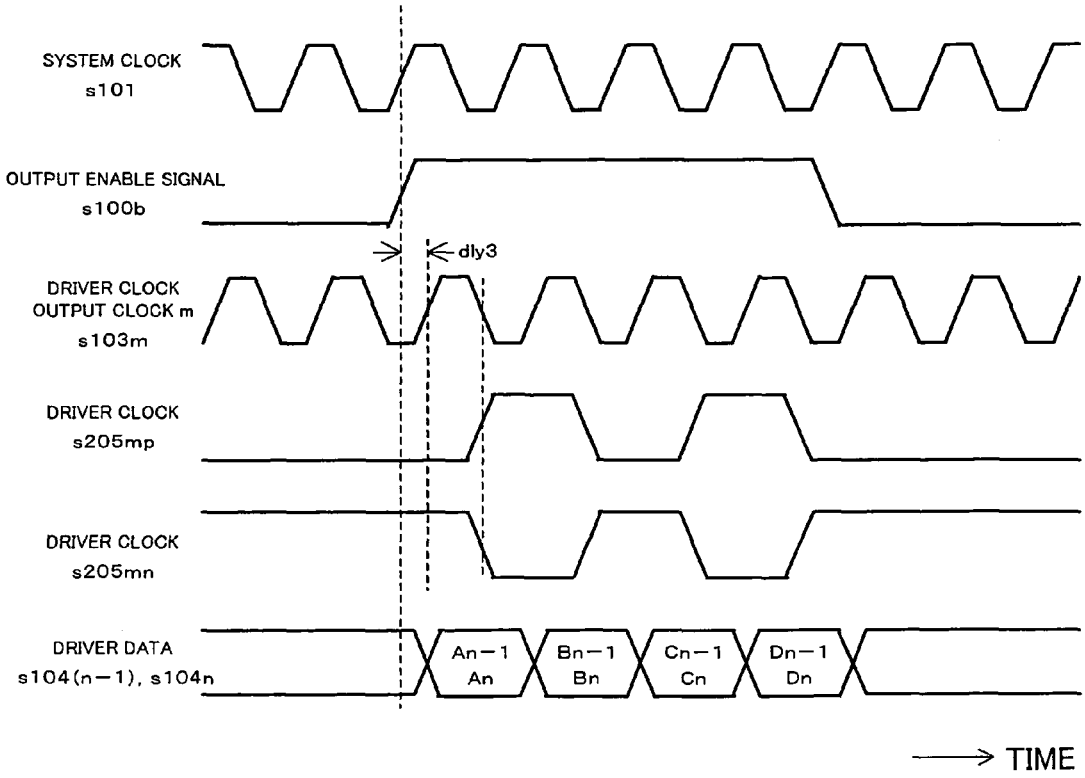
FIG. 10 is a timing chart for driver clock control sections in the driver controller according to the first modified example of the embodiment of the present invention.

FIG. 10 is a timing chart for the driver clock control sections 205. The differential driver clocks s2051*p* to s205*mp* and s2051*n* to s205*nm* that are synchronized with the negative edges of the driver clock output clocks s1031 to s103*m* are output during a time period (a period H in this embodiment) in which the output enable signal s100*b* indicates the active state. For example, FIG. 10 indicates a case in which for the clock s103*m*, a clock having a phase difference dly3 with respect to the system clock s101 is selected from the above-described clocks with different phases from the clock generation section 101.

The driver clock control section 205*m* outputs the differential driver clocks s205*mp* and s205*nm* having the ½ frequency and synchronized with the negative edge of the driver clock output clock s103*m*. At this time, the differential driver clocks s205*mp* and s205*nm* correspond to the driver data s104(*n*−1) and s104*n*. In this way, the driver clocks become the differential clocks having the ½ frequency, which enables the adjustment of AC timing to be made easily.

It will easily be appreciated that the driver clock control sections 2051 to 205*m* may output the driver clocks that are synchronized with the positive edges of the respective driver clock output clocks s1031 to s103*m*.

SECOND MODIFIED EXAMPLE

Next, a second modified example of the above-described embodiment will be described with reference to FIGS. 11 and 12. This modified example shows an exemplary structure including a set of driver-data output clock selection sections 3021 to a set of driver-data output clock selection sections 302*n*, with each set including k driver-data output clock selection sections, and driver data control sections 3041 to 304*n* for controlling k-bit data signals independently of each other.

Figure 11:
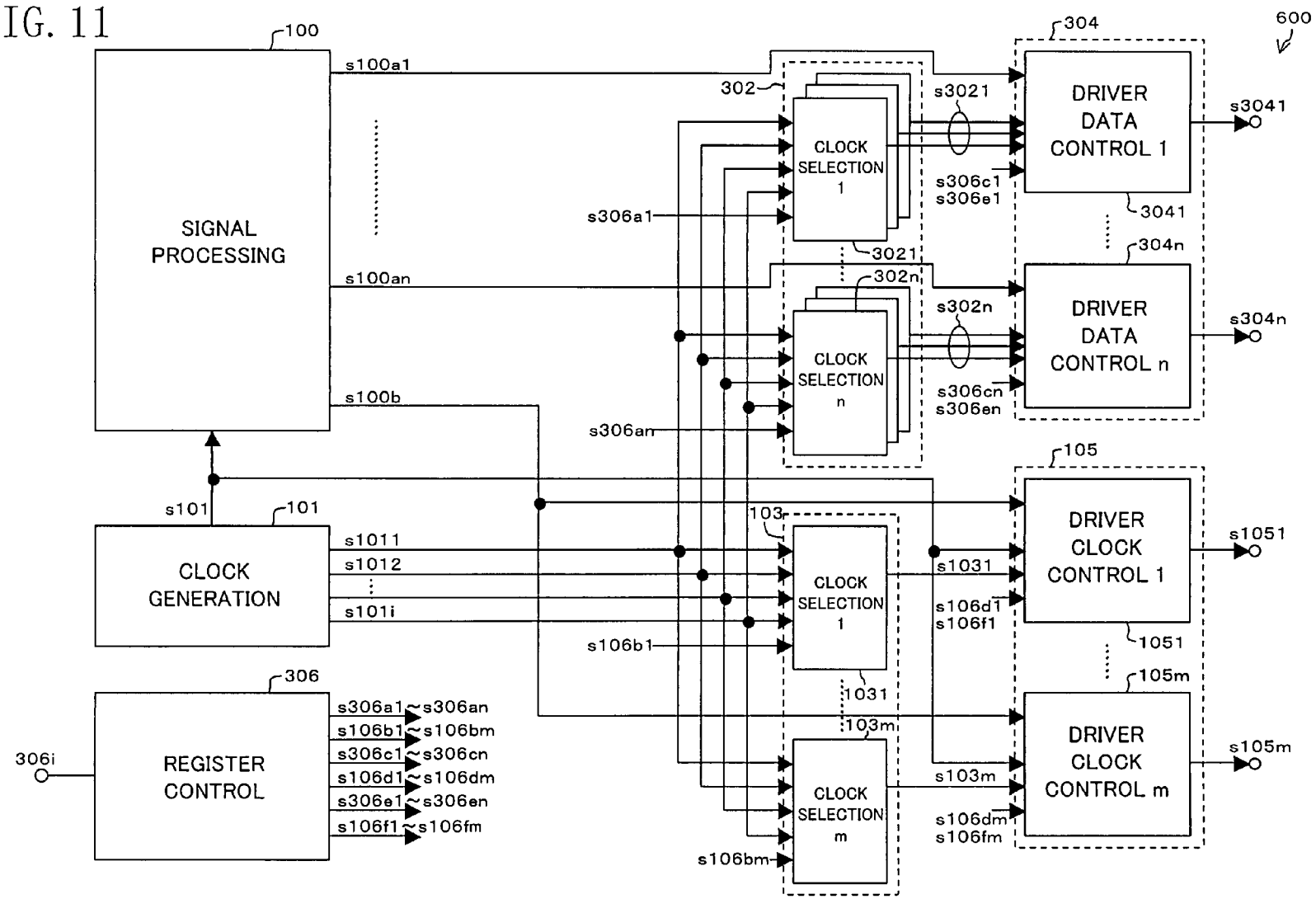
FIG. 11 is a block diagram illustrating the structure of a driver controller according to a second modified example of the embodiment of the present invention.
Figure 12:
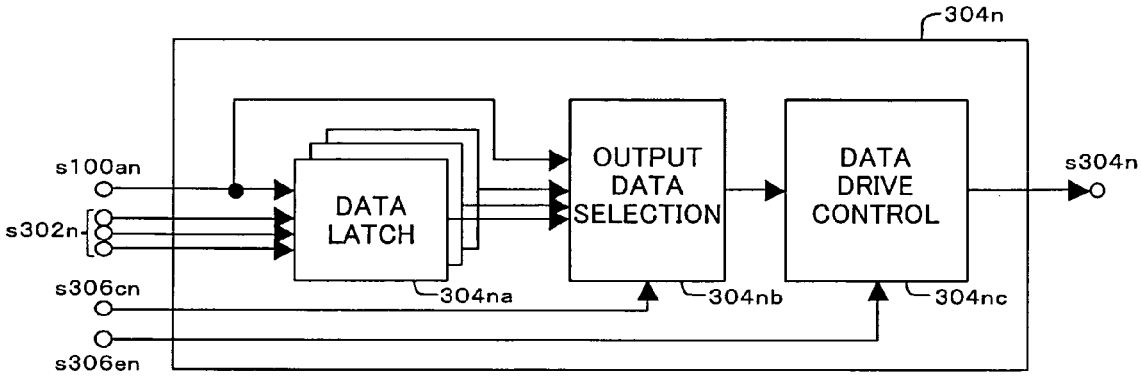
FIG. 12 is a block diagram illustrating the structure of a driver data control section in the driver controller according to the second modified example of the embodiment of the present invention.

Specifically, in FIG. 11, the reference numeral 302 denotes driver-data output clock selection sections. The number of driver-data output clock selection sections provided is k×n so as to correspond to the n k-bit data driver modules 6011 to 601*n*. The sets of driver-data output clock selection sections 3021 to 302*n* each select one of the clocks s1011 to s101*i* with different phases generated by the clock generation section 101, for each bit in accordance with an associated selection signal s306*a*1, . . . or s306*an* from the register control section 306 and then output k driver data output clocks s3021, . . . or s302*n*.

The reference numeral 304 denotes driver data control sections. The number of driver data control sections provided is n so as to correspond to the n data driver modules 6011 to 601*n*. The driver data control sections 3041 to 304*n* each latch the associated k-bit data signal s100*a*1, . . . or s100*an* from the signal processing section 100 by the associated k driver data output clocks s3021, . . . or s302*n* from the associated driver-data output clock selection sections 3021, . . . or 302*n* for each bit and select either one of the latch signal and the data signal s100*a*1, . . . or s100*an* for each bit in accordance with an associated selection signal s306*c*1, . . . or s306*cn* from the register control section 306. Thereafter, the driver data control sections 3041 to 304*n* determine the drive capability of the respective selected signals for each bit in accordance with respective selection signals s306*e*1 to s306*en* from the register control section 306 and output, as k-bit driver data s3041 to s304*n*, the respective selected signals from the output ports thereof to the corresponding data driver modules 6011 to 601*n*.

Now, the driver data control section 304*n* will be described with reference to FIG. 12. The reference numeral 304*na* denotes k-bit data latch sections, which latch the data signal s100*an* by the respective k driver data output clocks s302*n* and output the k-bit latch data.

The reference numeral 304*nb* indicates an output data selection section, which selects either the data signal s100*an* or the latch data for each bit in accordance with the selection signal s306*cn* and outputs the selected data.

The reference numeral 304*nc* denotes a driver data drive control section, which determines the drive capability of the selected data for each bit in accordance with the selection signal s306*en* and outputs, as the k-bit driver data s304*n*, the selected data from the output port thereof to the corresponding data driver module 601*n*.

Therefore, in this modified example, it is possible to perform phase control and drive capability control for each bit in the data driver modules, which enhances the effect of reducing noise.

THIRD MODIFIED EXAMPLE

Next, a third modified example of the above-described embodiment will be described with reference to FIGS. 13 and 14. This modified example shows an exemplary structure including driver data control sections 4041 to 404*n* for performing delay control for k-bit data signals independently of each other.

Figure 13:
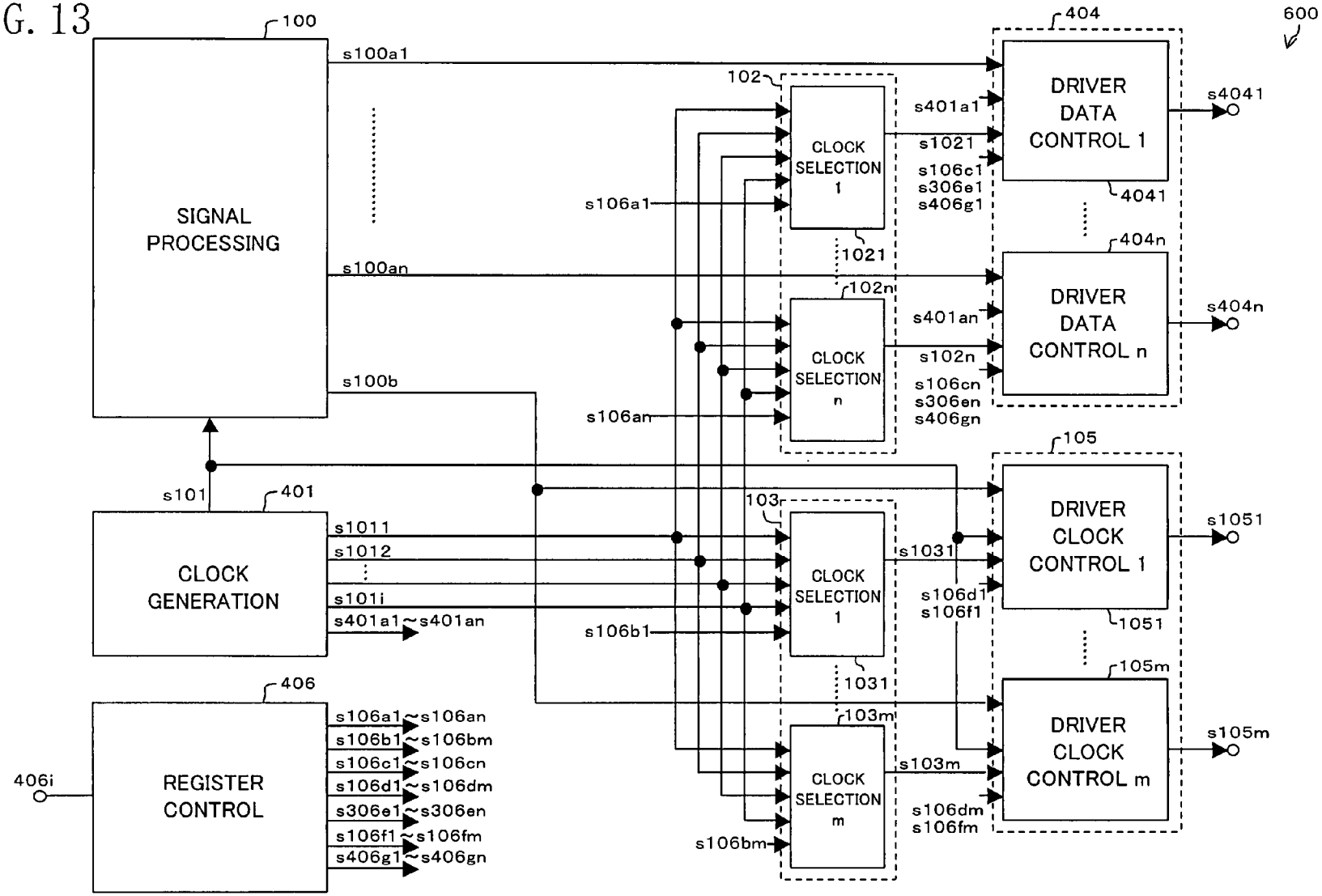
FIG. 13 is a block diagram illustrating the structure of a driver controller according to a third modified example of the embodiment of the present invention.
Figure 14:
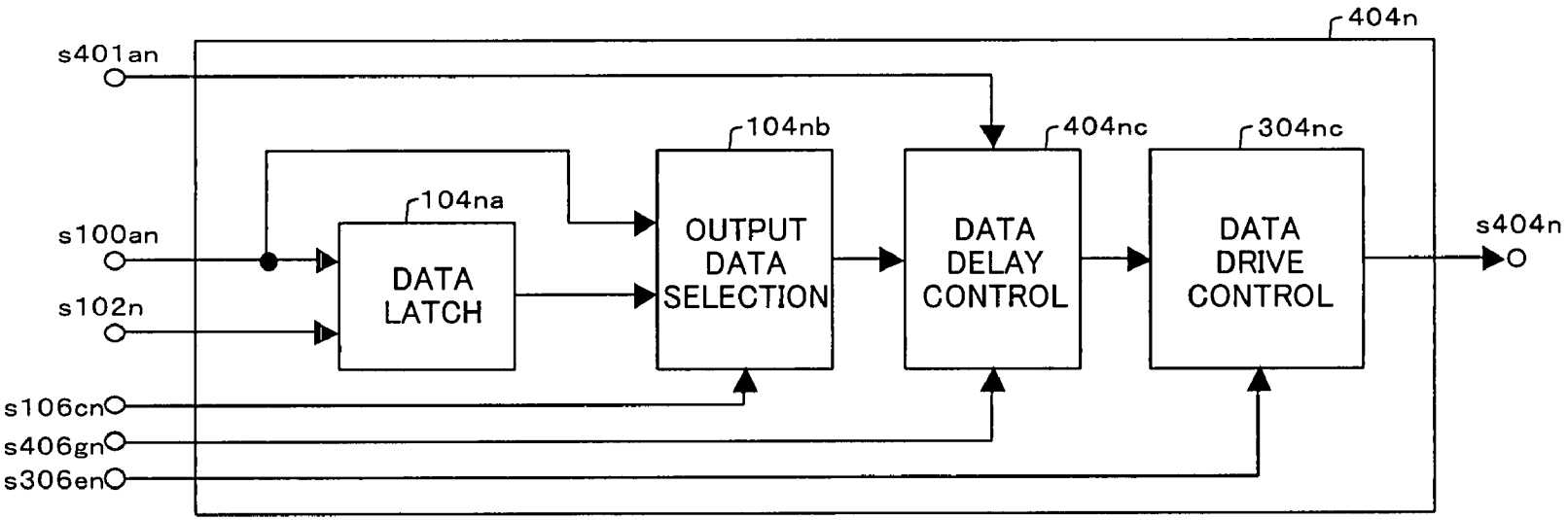
FIG. 14 is a block diagram illustrating the structure of a driver data control section in the driver controller according to the third modified example of the embodiment of the present invention.

Specifically, in FIG. 13, the reference numeral 401 indicates a clock generation section, which generates a system clock s101, and a plurality of clocks s1011 to s101*i* having different phases (where i is an integer equal to or greater than 2) with the system clock s101 used as a reference phase, and outputs items of phase information s401*a*1 to s401*an*. The items of phase information are bias voltage of a delay line in a DLL and the like.

The reference numeral 404 denotes driver data control sections. The number of driver data control sections provided is n so as to correspond to the n data driver modules 6011 to 601*n*. The driver data control sections 4041 to 404*n* latch the respective k-bit data signals s100*a*1 to s100*an* from the signal processing section 100 by the respective driver data output clocks s1021 to s102*n* from the driver-data output clock selection sections 1021 to 102*n*, each select either one of the latch signal and the associated data signal s100*a*1, . . . or s100*an* in accordance with an associated selection signal s106*c*1, . . . or s106*cn* from a register control section 406, and perform delay control for each bit in accordance with an associated control signal s406*g*1, . . . or s406*gn* from the register control section 406. Thereafter, the driver data control sections 4041 to 404*n* determine the drive capability of the respective selected signals for each bit according to respective selection signals s306*e*1 to s306*en* from the register control section 406 and output, as k-bit driver data s4041 to s404*n*, the respective selected signals from the output ports thereof to the corresponding data driver modules 6011 to 601*n*.

Now, the driver data control section 404*n* will be described with reference to FIG. 14. The reference numeral 404*nc* denotes a k-bit data delay control section for performing delay control for the selected data for each bit in accordance with the control signal s406*gn* and outputting the delayed data. The delay for each bit may be produced by using the phase information item s401*an*.

The reference numeral 304*nc* denotes a driver data drive control section, which determines the drive capability of the delayed data for each bit in accordance with the selection signal s306*en* and outputs, as the k-bit driver data s404*n*, the delayed data from the output port thereof to the corresponding data driver module 601*n*.

Therefore, in this modified example, the phase control for each bit in the data driver modules is performed after the latching, and thus can be carried out in a wider range, which allows coarse adjustment to be made in the output data selection section and fine adjustment to be made in the data delay control section.

FOURTH MODIFIED EXAMPLE

Next, a fourth modified example of the above-described embodiment will be described with reference to FIG. 15. This modified example shows a structure including a test data control section 507.

Figure 15:
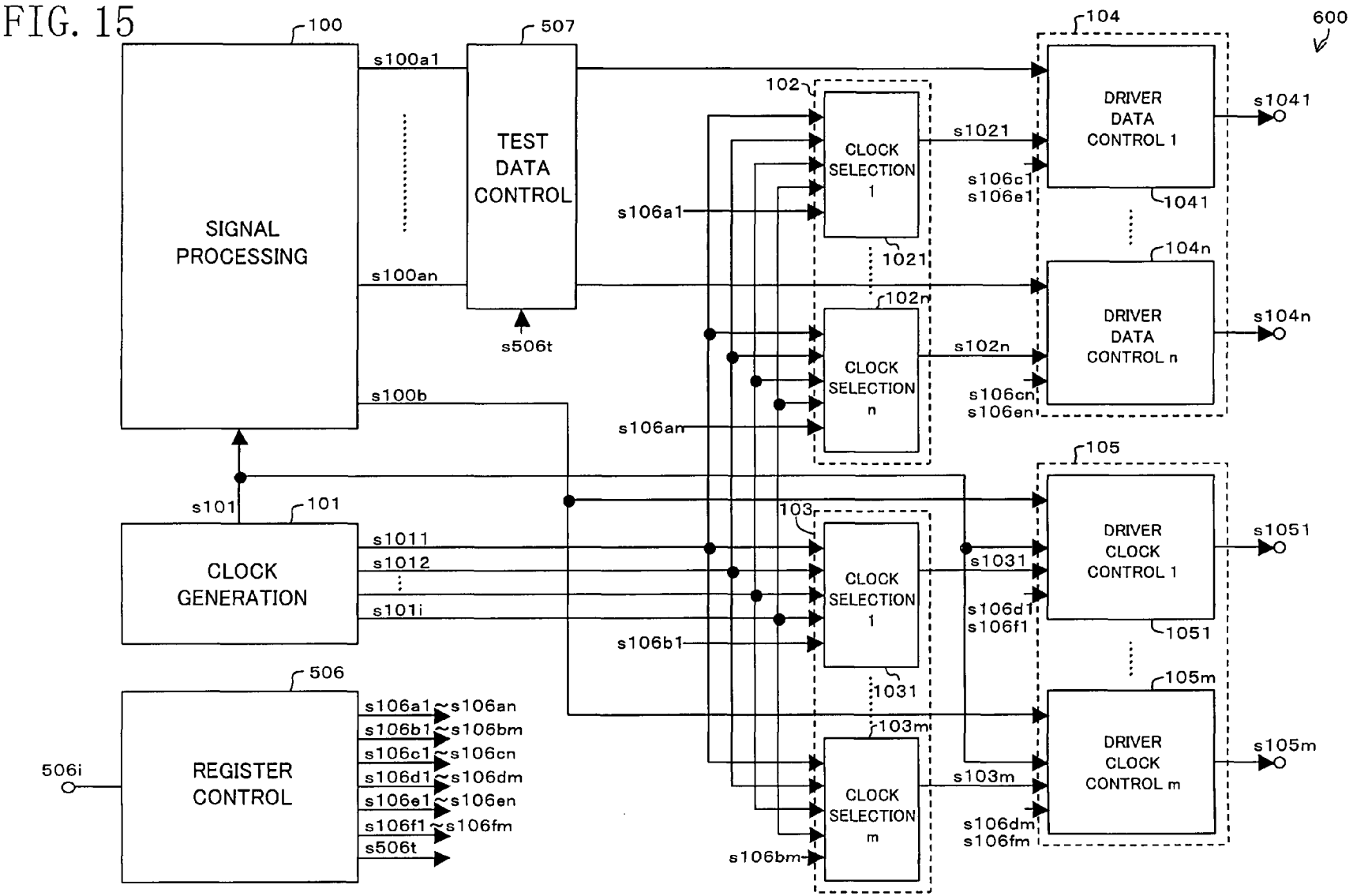
FIG. 15 is a block diagram illustrating the structure of a driver controller according to a fourth modified example of the embodiment of the present invention.

Specifically, in FIG. 15, the reference numeral 507 indicates the test data control section, which generates any test data in accordance with a control signal s506*t* from a register control section 506 and outputs the generated test data. At this time, for each of the data signals corresponding to the respective data driver modules 6011 to 601*n*, either the data signal or the test data signal may be selected and output.

Therefore, in this modified example, it is possible to generate any test data signals irrespective of the data signals, whereby conditions for AC timing evaluation can be set easily. Also, in some display panels, noise can be reduced further by fixing unused driver data output.

As described above, according to the present invention, individual phase-adjustment is performed for the timing of the output of the respective driver data and respective driver clocks to the data driver modules. This allows the respective driver data to change at different points in time, whereby the occurrence of noise is reduced, and even if there is propagation skew, optimization of AC timing is achievable. The present invention is thus applicable to driver controllers for controlling a plurality of data driver modules in display panels, such as PDPs and LCDs.

What is claimed is:

1. A driver controller for controlling a plurality of data driver modules included in a display panel, the driver controller comprising:

a clock generation section for generating and outputting a system clock to be supplied to a signal processing section and a plurality of clocks with different phases and with a same frequency;

driver-data output clock selection sections, each for selecting one of the plurality of clocks with different phases and with the same frequency received from the clock generation section and outputting a driver data output clock;

driver-clock output clock selection sections, each for selecting one of the plurality of clocks with different phases received from the clock generation section and outputting a driver clock output clock;

driver data control sections, each for selecting either a data signal from the signal processing section or latch data obtained by latching the data signal by an associated one of the driver data output clocks and outputting, as driver data, the selected data signal or the selected latch data to an associated one of the data driver modules;

driver clock control sections, each for outputting a driver clock in synchronization with either the system clock or an associated one of the driver clock output clocks during a time period in which an output enable signal from the signal processing section indicates an active state, the output enable signal indicating a validity period of the data signal and being received from the signal processing section; and a register control section for controlling driver-data-output-clock selection signals for selecting the driver data output clocks and driver-clock-output-clock selection signals for selecting the driver clock output clocks, wherein output timing of the respective driver data and output timing of the respective driver clocks to the data driver modules are individually phase-adjusted for the associated driver data output clock and for the associated driver clock output clock, respectively.

2. The driver controller of claim 1, wherein the clock generation section generates the clocks with different phases within one clock cycle by producing a fixed delay with the system clock being a reference phase.

3. The driver controller of claim 1, wherein the driver data control sections each include:

a data latch section for latching the data signal by the associated driver data output clock;

an output data selection section for selecting either the data signal or an output signal from the data latch section and outputting the selected data signal; and a driver data drive control section for controlling an output driving power of the selected data signal and outputting the driver data.

4. The driver controller of claim 3, wherein the driver data drive control section selects one of a plurality of different driving powers to control the output driving power of the selected data signal.

5. The driver controller of claim 1, wherein the driver clock control sections each include:

a base clock selection section for selecting either the system clock or the associated driver clock output clock and outputting a base driver clock;

a driver clock generation section for generating the driver clock in synchronization with either a positive or negative edge of the base driver clock during the time period in which the output enable signal indicates the active state; and a driver clock drive control section for controlling an output driving power of the driver clock.

6. The driver controller of claim 5, wherein the driver clock drive control section selects one of a plurality of different driving powers to control the output driving power of the driver clock.

7. The driver controller of claim 5, wherein the driver clock control sections each include, in place of the driver clock generation section, a differential clock generation section for generating differential driver clocks, whose frequency is one-half of that of the base driver clock, in synchronization with either a positive or negative edge of the base driver clock during the time period in which the output enable signal indicates the active state.

8. The driver controller of claim 1, wherein the number of the data driver modules that are connected to the driver controller is equal to or smaller than n, where n is an integer equal to or greater than 2, and the number of the driver data control sections provided is n.

9. The driver controller of claim 8, wherein the number of the driver-data output clock selection sections provided is n so as to correspond to the driver data control sections.

10. The driver controller of claim 1, wherein the number of the data driver modules that are connected to the driver controller is equal to or smaller than n, where n is an integer equal to or greater than 2, the data driver modules form m group or groups, where m is any integer equal to or greater than 1 but not more than n, and the number of the driver clock control sections provided is m.

11. The driver controller of claim 10, wherein the number of the driver-clock output clock selection sections provided is m so as to correspond to the driver clock control sections.

12. The driver controller of claim 1, wherein the driver data for each of the data driver modules contains k bits, where k is an integer equal to or greater than 2;

the number of the driver-data output clock selection sections provided for each of the driver data control sections ranges between one to k, as necessary; and the driver data control sections each include a data latch section or sections corresponding in number to the driver-data output clock selection section or sections provided.

13. The driver controller of claim 1, wherein the driver data for each of the data driver modules contains k bits, where k is an integer equal to or greater than 2;

the number of the driver-data output clock selection sections provided for each of the driver data control sections is one; and the driver data control sections each include a data delay control section capable of delaying the k-bit selected data signal for each bit independently of each other.

14. The driver controller of claim 13, wherein the data delay control section delays the selected data signal by multiple amounts of delay to generate a plurality of delayed data and selects and outputs one of the delayed data.

15. The driver controller of claim 14, wherein the data delay control section determines the multiple amounts of delay according to phase information from the clock generation section.

16. The driver controller of claim 1, further comprising a test data control section for generating any test data signal externally through the register control section, selecting either the data signal output from the signal processing section or the test data signal, and supplying the selected signal to the driver data control sections.

17. The driver controller of claim 16, wherein the test data control section selects either the data signal or the test data signal for each of the data driver modules.

18. The driver controller of claim 1, wherein the clocks with different phases and with the same frequency have the same frequency as the system clock.

19. The driver controller of claim 1, wherein the system clock and the driver clock have a same frequency.

20. The driver controller of claim 19, wherein the system clock, the driver data output clock, the driver clock output clock and the driver clock have the same frequency.

* * * * *